US008528948B2

(12) United States Patent
Bettin et al.

(10) Patent No.: US 8,528,948 B2
(45) Date of Patent: Sep. 10, 2013

(54) AUXILIARY LOCKING DRIVE FOR A MOTOR VEHICLE LOCK

(75) Inventors: Axel Bettin, Hattingen (DE); Gregor Buedding, Duisburg (DE); Simon Brose, Hattingen (DE); Michael Langferman, Shanghai (CN)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 1088 days.

(21) Appl. No.: 12/327,370

(22) Filed: Dec. 3, 2008

(65) Prior Publication Data

US 2009/0145182 A1 Jun. 11, 2009

(30) Foreign Application Priority Data

Dec. 3, 2007 (DE) ..... 20 2007 016 888 U
Jun. 10, 2008 (DE) ..... 20 2008 007 719 U

(51) Int. Cl.
*E05C 3/06* (2006.01)

(52) U.S. Cl.
USPC ..... 292/201

(58) Field of Classification Search
USPC ..... 292/201, 216, DIG. 23
See application file for complete search history.

(56) References Cited

U.S. PATENT DOCUMENTS 3,154,302 A * 10/1964 Maruyama ..... 49/280
4,691,584 A * 9/1987 Takaishi et al. ..... 74/471 R
5,158,330 A 10/1992 Weyerstall et al.
5,273,324 A 12/1993 Kobayashi
6,536,814 B2 * 3/2003 Kachouh ..... 292/216
6,550,825 B2 * 4/2003 Ostrowski et al. ..... 292/199
7,443,121 B2 * 10/2008 Nagai et al. ..... 318/434
7,575,270 B2 * 8/2009 Nagai et al. ..... 296/155
7,757,823 B2 * 7/2010 Choi ..... 188/72.7
8,033,584 B2 * 10/2011 Akizuki et al. ..... 292/216
2004/0135378 A1 7/2004 Buedding et al.
2007/0125605 A1 * 6/2007 Choi ..... 188/2 D
2011/0012380 A1 1/2011 Bendel et al.

FOREIGN PATENT DOCUMENTS

DE 31 46 804 A1 6/1983
DE 103 20 660 A1 12/2004
DE 10 2006 048 026 A1 5/2007
EP 0 271 635 A1 6/1988
EP 1 074 681 A1 2/2001

* cited by examiner

*Primary Examiner* — Carlos Lugo
*Assistant Examiner* — Mark Williams
(74) *Attorney, Agent, or Firm* — Roberts Mlotkowski; Safran & Cole, P.C.; David S. Safran

(57) ABSTRACT

An auxiliary locking drive for a motor vehicle lock having its own drive housing and being located separate from the vehicle lock in the installed state. The auxiliary locking drive can be coupled to the vehicle lock by way of a transmission that transmits a linear driving motion produced by a drive motor to the vehicle lock for transferring the vehicle lock from the half-locked state into the main locked state by the driving motion. The auxiliary locking drive, for producing the linear driving motion, has a feed gear mechanism which is connected downstream of the drive motor and is made as a spindle-spindle nut gearing with a spindle and a spindle nut.

18 Claims, 6 Drawing Sheets

AUXILIARY LOCKING DRIVE FOR A MOTOR VEHICLE LOCK

BACKGROUND OF THE INVENTION

1. Field of Invention

The invention relates to an auxiliary locking drive for a motor vehicle lock having its own drive housing and being located separately from the vehicle lock in the installed state, being coupled to the vehicle lock by way of a transmission, having a drive motor, and in the mounted state, the drive motor producing a linear driving motion that is transmitted to the vehicle lock by way of the transmission so that the vehicle lock can be transferred from a half-locked state into a main locked state by the driving motion.

2. Description of Related Art

Here, the expression motor vehicle lock is defined as all types of door/hood/trunk or hatch locks.

The vehicle lock is equipped with conventional latching elements, a latch and a ratchet, the ratchet keeping the latch in the main locked position and in the half-locked position. The ratchet is then in the engaged state. The latch can be moved into retaining engagement with a striker or the like which is located on the body. Here, the striker or the like can be assigned to the vehicle lock.

In the course of enhancing the ease of operation, current vehicle locks are provide with various automatic functions. They include, for example, a striker function in which the vehicle lock is transferred by motor from the half-locked state into the main locked state. It is advantageous that the user need move the motor vehicle door only to the half-locked state for locking and that this is possible with comparatively little effort. The counter-pressures of the door seal are not yet acting here. Only moving from the half-locked state into the main locked state is associated with the compression of the door seal, and thus, with a considerable expenditure of force; this takes place by means of an auxiliary locking drive.

Different versions for implementation of the auxiliary locking function are known. One version (German Patent DE 39 35 804 C2 and corresponding U.S. Pat. No. 5,158,330) calls for the striker which interacts with the latch to be moved by a motor for pulling the vehicle door tight. In another version (German Patent Application DE 102 39 734 A1 and corresponding U.S. Patent Application Publication 2004/0135378 A2), the latch can be moved by means of the locking aid by a motor from the half-locked position into the main locked position, and thus, the vehicle lock can be moved altogether from the half-locked state into the main locked state.

In the latter implementation of the auxiliary locking function, the auxiliary locking drive is activated when the latch reaches the half-locked position. For this purpose, there is a control unit in the form of an auxiliary locking control.

In the aforementioned arrangements, it has been found to be disadvantageous that the amount of installation space required in the region of the vehicle lock is undesirably high due to the integration of the auxiliary locking drive; this leads to major structural limitations. Furthermore, the modularity of the arrangement with respect to the implementation of the additional function "locking aid" is low.

In the known auxiliary locking drive which underlies the present invention (German Patent Application DE 10 2006 048 026 A1), the auxiliary locking drive is located separately from the vehicle lock and is coupled to the vehicle lock via a Bowden cable by drive engineering. This solves the problem of installation space in the region of the vehicle lock in a satisfactory manner and corresponds to a modular execution.

In any case, the problem of installation space in the known auxiliary locking drive has simply been shifted. Known auxiliary locking drives which are made in this way are of considerable size; this leads to corresponding installation space problems at the respective site away from the vehicle lock. Furthermore, the known auxiliary locking drives are of considerable weight.

SUMMARY OF THE INVENTION

Therefore, a primary object of the present invention is to embody and develop the known auxiliary locking drive such that the amount of installation space required and the weight of the auxiliary locking drive are reduced.

The aforementioned problem is solved in an auxiliary locking drive of the initially mentioned type in that the auxiliary locking drive for producing the linear driving motion has a feed gear mechanism which is connected downstream of the drive motor and that the feed gear mechanism is a spindle-nut gearing with a spindle and a spindle nut.

First of all, it is important that, by providing the auxiliary locking drive with a feed gear mechanism which is made as spindle-nut gearing to produce a linear driving motion, this leads to a minimum installation space requirement. Furthermore, this arrangement can be implemented with a minimum number of components, and additionally, leads to a low weight.

In accordance with a preferred configuration, the spindle is assigned to the drive side and the spindle nut is assigned to the driven side of the feed gear mechanism. This means that the spindle is driven by the drive motor, while the spindle nut runs along the spindle; this corresponds to the linear driving motion here.

An especially compact arrangement can be achieved by the spindle nut being assigned to the drive side and the spindle being assigned to the driven side of the feed gear mechanism. This means that, at this point, the spindle nut and not the spindle is driven by the drive motor. In an especially preferred embodiment, the drive shaft of the drive motor is made as a hollow shaft which, at the same time, forms the spindle nut of the feed gear mechanism. In this especially preferred embodiment, it is provided that the drive motor, with respect to driving the hollow shaft, is a direct electrical drive. In this case, the amount of installation space required can be minimized by the inter-nested arrangement of the drive motor and the feed gear mechanism.

In especially preferred configurations, the auxiliary locking drive in accordance with the invention can be easily designed or parameterized for the respective application. Different applications can require specifically different forces, speeds and feeds; this leads accordingly to different drive motors, intermediate gearing or feed gear mechanisms. Depending on the configuration, the drive housing and optionally the end piece of the Bowden cable must be adapted. This is especially easily possible by a telescoping configuration of the parts of the drive housing.

In accordance with further preferred embodiments, there is a lengthwise guide which is located parallel to the spindle and on which the spindle nut runs and there is a second spindle which is coupled to the drive shaft of the drive motor and which has a second spindle nut thread. These measures serve to prevent jamming of the spindle nut relative to the spindle even when the coupling of the core of the Bowden cable relative to the axis of the spindle is coupled off-center to the feed nut.

The invention is explained in detail below with reference to the accompanying drawings.

DETAILED DESCRIPTION OF THE INVENTION

Figure 1:
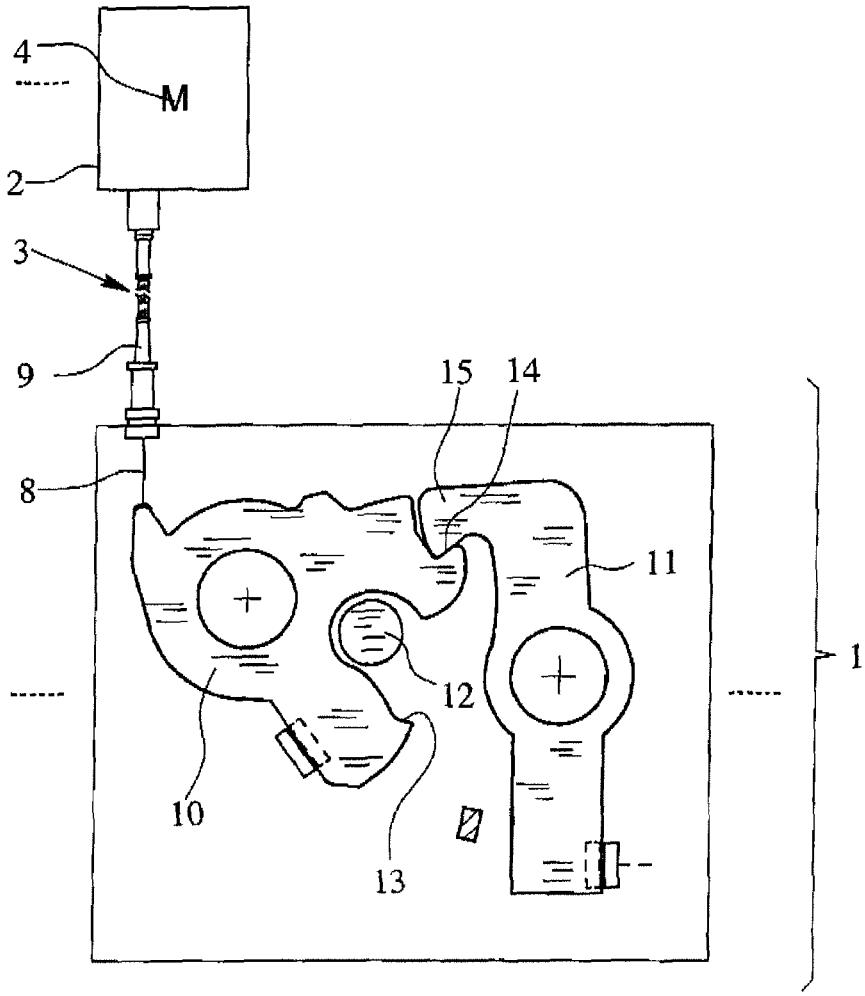
FIG. 1 shows the structure of the auxiliary locking drive in accordance with the invention in the installed state.
Figure 2:
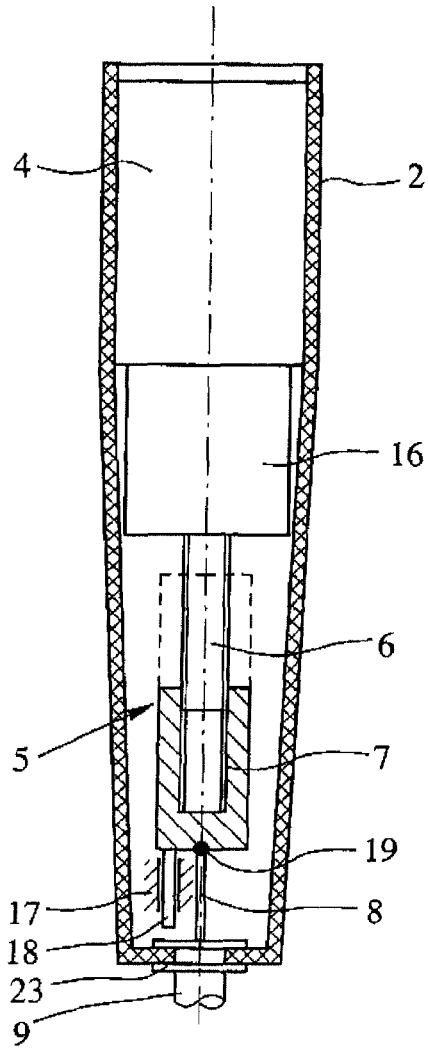
FIG. 2 is a cutaway side view of a first embodiment of the auxiliary locking drive of FIG. 1.
Figure 3:
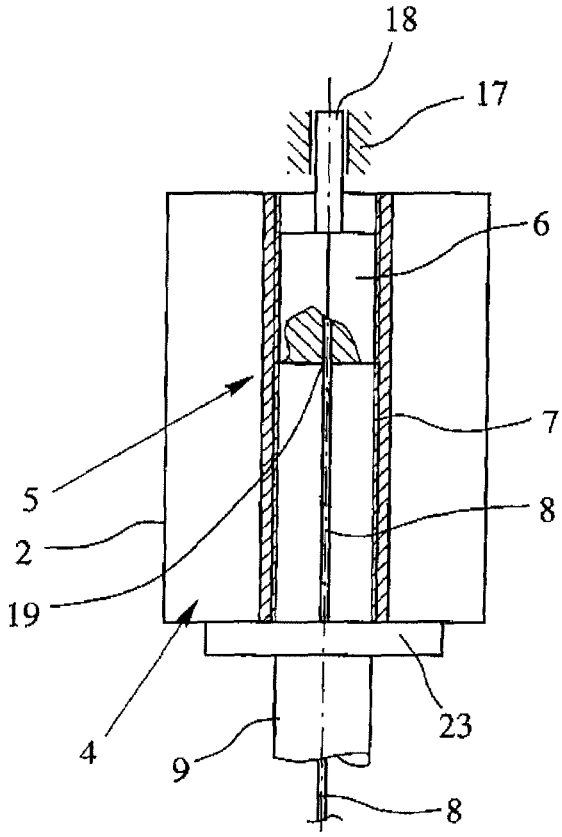
FIG. 3 is a cutaway side view of a second embodiment of the auxiliary locking drive as shown in FIG. 1.
Figure 4:
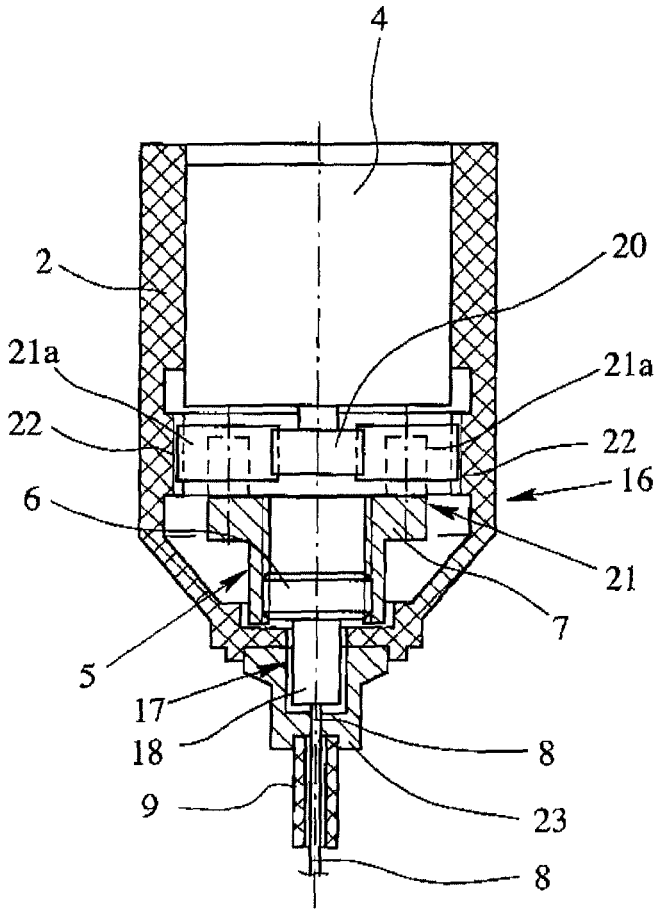
FIG. 4 is a cutaway side view of a third embodiment of the auxiliary locking drive as shown in FIG. 1.

The structure of an auxiliary locking drive in accordance with the invention which is shown in FIG. 1 applies to all the embodiments shown in FIGS. 2 to 4. This auxiliary locking drive is assigned to a vehicle lock 1. With respect to a broad understanding of the concept "motor vehicle lock" reference should be made to the Background part of this specification.

In all the illustrated embodiments, the auxiliary locking drive has its own drive housing 2 and is located separately from the vehicle lock 1 in the installed state. As can be seen in FIG. 1, the auxiliary locking drive is coupled to the vehicle lock 1 by way of a transmission means 3.

As can be seen in detail in FIGS. 2 to 4, the auxiliary locking drive has a drive motor 4 which, in the mounted state, is able to produce a linear driving motion that is transmitted to the vehicle lock 1 by way of the transmission means 3. This linear driving motion allows the vehicle lock 1 to be transferred from the half-locked state into the main locked state. These states were explained in the Background part of this specification.

FIGS. 2 to 4 also show, in three embodiments, that the auxiliary locking drive for producing the linear driving motion has a feed gear mechanism 5 which is connected downstream of the drive motor 4 and that the feed gear mechanism 5, in all embodiments, is made as spindle-spindle nut gearing with a spindle 6 and a spindle nut 7.

The vehicle lock 1 can be largely assigned to any locking elements in a vehicle lock. Preferably, the vehicle lock 1 is assigned to a vehicle door or hatch. The vehicle door can also be a sliding door.

The transmission means 3 preferably is a Bowden cable which, generally, has a cable core 8 and a cable sheath 9. Depending on the available installation space, the use of other types of transmission means 3 are possible. One example of the implementation of the transmission means 3 is a simple cable pull. Another example of the implementation of the transmission means 3 is a rack with teeth in the vehicle lock 1 which can be caused to engage the latch 1. Another example of the implementation of the transmission means 3 is a linkage which can also contain a universal coupling. It is fundamentally also possible to provide the transmission means 3 with a hydraulic connection.

Here, the driving motion is a linear driving motion. Accordingly, the use of spindle-spindle nut gearing for the feed gear mechanism 5 is especially advantageous. Depending on the configuration of the vehicle lock 1, an adapted design of the auxiliary locking drive with respect to the scope of the driving motion and to the level of the driving force is necessary.

In all cases, first of all, the vehicle lock 1 has latching elements, the latch 10 and ratchet 11 as well as a striker 12 which is assigned to the latch 10. The fundamental interaction of these components was explained in the Background part of this specification.

In the preferred embodiment shown in FIG. 1, the latch 10 can be moved into a half-locked position (not shown) and into the illustrated main locked position. For this purpose, the latch 10 has a pre-catch 13 and a main catch 14 which each of which can be caused to engage an engagement section 15 of the ratchet 11. For the preferred configuration shown in FIG. 1, it is also such that the auxiliary locking drive, in the installed state, is coupled by drive engineering to the latch 10 and that the latch 10 can be moved by the driving motion produced by the auxiliary locking drive from the half-locked position into the main locked position so that the vehicle lock 1, as a whole, can be moved from the half-locked position into the main locked position. In this connection, the auxiliary locking drive preferably first causes movement of the latch 10 into an overtravel position so that the ratchet 11 can engage. Then, the latch 10 drops back into the main locked position and is kept there by the ratchet 11. In this arrangement, the core 8 of the Bowden cable 3 is preferably coupled to the latch 10.

However, fundamentally, it is also possible for the auxiliary locking drive to act on the striker 12 instead of on the latch 10. In this embodiment (not shown), it is provided that the striker 12, for its part, can be moved into the half-locked position and into the main locked position, that the auxiliary locking drive, in the installed state, is coupled by drive engineering to the striker 12 and that the striker 12, by the driving motion produced by the auxiliary locking drive, can be moved from the half-locked position into the main locked position so that the vehicle lock 1 altogether can be moved from the half-locked state into the main locked state.

Both versions of the vehicle locks 1 require transmission of a driving motion via the transmission means 3, here via the Bowden cable 3. In any case, the range of motion and the force required are different depending on the version; this has corresponding effects on the layout of the auxiliary locking drive.

The concept of "spindle-spindle nut gearing" and the terms "spindle" and "spindle nut" can be broadly understood in conjunction with the feed gear mechanism 5. Fundamentally, it is provided here that the spindle 6 has a spindle thread and that the spindle nut 7 has a spindle nut thread. However, it can also be provided that either the spindle 6 or the spindle nut 7 have a corresponding thread.

In particular, it can be provided that the spindle 6 has a driver which engages the thread of the spindle nut 7. Alternatively, it can also be provided that the spindle nut 7 has a driver which engages the thread of the spindle 6. A "driver" is defined here as any shape which is suited to engaging a thread and as a result for advancing the spindle nut 7 or the spindle 6. For example, the driver can be a simple projection or the like.

In conjunction with the threads of the spindle 6 and the spindle nut 7, it is also pointed out that the pitch of the thread of the spindle 6 and/or the spindle nut 7 can change over its lengthwise extension. This can result in a mechanical advantage of the spindle-spindle nut drive, therefore of the feed gear mechanism 5, changing over an auxiliary locking process. This can be advantageous depending on available installation space conditions.

FIG. 2 shows an arrangement in which the spindle 6 is assigned to the drive side and the spindle nut 7 is assigned to the driven side of the feed gear mechanism 5. This means that the spindle 6 can be driven by the drive motor 4 and that the spindle nut 7 constitutes the output of the feed gear mechanism 5. Accordingly, it is preferably provided that the transmission means 3, here the core 8 of the Bowden cable 3, in the mounted state, is coupled directly to the spindle nut 7. Furthermore, here it is preferably such that the spindle nut 7 of the feed gear mechanism 5 is rotationally fixed, but able to move lengthwise. The locking element of the spindle nut 7 is addressed below.

In the preferred embodiment shown in FIG. 2, intermediate gearing 16 is connected downstream of the drive motor 4 and with its output side acts on the spindle 6. However, fundamentally, it can also be provided that the drive shaft of the drive motor 4 (not shown), is coupled directly to the spindle 6. In an especially preferred embodiment, the drive shaft of the drive motor 4, itself, forms the spindle 6.

In the embodiment shown in FIG. 2, therefore, the spindle 6 is driven, while the spindle nut 7 is rotationally fixed, but able to move lengthwise. As a result, here, the rotary motion of the spindle 6 is converted into a lengthwise motion of the spindle nut 7.

For the locking element, there is a lengthwise guide 17 which is engaged by a projection 18 or the like of the spindle nut 7. Accordingly, when the spindle 6 turns the spindle nut 7 moves up or down the length of the spindle. FIG. 2 shows the initial position of the spindle nut 7. The end position of the spindle nut 7 after completion of the auxiliary locking process is shown in broken lines.

Here, the spindle nut 7 is preferably made as a bushing which is sealed on the end face, which is at the bottom in FIG. 2. It is preferably such that this end face provides the coupling point 19 for the transmission means 3, which in this case is the core 8 of the Bowden cable 3.

In order to simplify the installation of the auxiliary locking drive, especially of the Bowden cable 3, it is preferably provided that the spindle nut 7. together with the transmission means 3, here with the core 8 of the Bowden cable 3, form a pre-mountable unit. In particular, it is provided that the spindle nut 7, in the installed state, is inseparably connected to the transmission means 3, here, to the core 8 of the Bowden cable 3. It is possible for the spindle nut 7 to be produced by a plastic injection molding process and that the Bowden cable core 8 is embedded in the spindle nut 7 during that process. Other means of connection can be advantageously used as well.

In the preferred embodiment shown in FIG. 2, the drive motor 4, intermediate gearing 16 which may be present and the feed gear mechanism 5 are arranged in succession in the drive housing 2. In this connection, it is also preferable that these components are aligned relative to the drive shaft of the drive motor 4 and/or at the axle of the spindle 6.

Another arrangement is shown in FIG. 3. Here, the drive motor 4 and the feed gear mechanism 5 in the drive housing 2 are located at least partially inter-nested in one another relative to the lengthwise extension of the auxiliary locking drive. This inter-nested arrangement can also relate to intermediate gearing 16 of FIG. 2 which may be present in the FIG. 3 arrangement as well.

Here, the spindle nut 7 is preferably assigned to the drive side and the spindle 6 is assigned to the driven side of the feed gear mechanism 5. Different from the embodiment shown in FIG. 1, therefore, the spindle nut 7 is driven here by the drive motor 4, while the spindle 6 runs along the spindle nut 7. Here, the spindle 6 forms the output of the feed gear mechanism 5 and is accordingly coupled, preferably directly, to the transmission means 3, which, in this case, is the core 8 of the Bowden cable 3.

In this connection, it is also preferable that the spindle 6 of the feed gear mechanism 5 is arranged to be rotationally fixed, but able to move lengthwise. As a result, the rotary motion of the spindle 6 is converted into longitudinal motion of the spindle nut 7.

The aforementioned inter-nesting of the individual components is achieved in the embodiment which is shown in FIG. 3 by the drive shaft of the drive motor 4 being made as a hollow shaft and by the hollow shaft forming the spindle nut 7 of the feed gear mechanism 5, and for this purpose, preferably has a spindle nut thread. Within the spindle nut 7 is the spindle 6, the locking element again being formed by a type of projection 18 which runs in a lengthwise guide 17.

It is apparent in FIG. 3 that the amount of installation space required is especially small, viewed in the lengthwise extension of the auxiliary locking drive. This is achieved especially by the drive motor 4, with respect to the driving of the hollow shaft, being made in the manner of a direct electrical drive. The hollow shaft, here the spindle nut 7, therefore, at the same time, forms the rotor of the drive motor.

It can be further taken from FIG. 3 that the spindle 6 of the feed gear mechanism 5 is located completely within the spindle nut 7. Here, this preferably applies regardless of the position in which the auxiliary locking drive is found.

In the preferred embodiment shown in FIG. 3, it is of interest that the extension of the drive motor 4 corresponds altogether to the extension of the drive shaft or of the spindle nut 7. This can be attributed first of all to the drive motor 4 being made in the manner of a direct electric drive.

In order to ensure installation as simple as possible, in one preferred configuration, the spindle 6 together with the transmission means 3, here with the core 8 of the Bowden cable 3, form a pre-mountable unit. The same applies here as was stated above regarding the spindle nut 7.

It was already pointed out above that intermediate gearing 16 can be connected between the drive motor 4 and the feed gear mechanism 5. This is shown schematically in FIG. 2.

FIG. 4 shows another preferred embodiment in which the intermediate gearing 16 is a planetary gearing system. The planetary gearing system generally has a sun wheel 20, a planet gear carrier 21 and an internal gear 22. Here, it is advantageous that the planetary gearing system enables an especially space-saving structure. FIG. 4 also shows the planet gears 21*a* which are supported on the planet gear carrier 21.

In an especially preferred configuration, one of the components comprised of the sun wheel 20, planet gear carrier 21 and internal gear 21 are assigned to the drive motor 4, especially the drive shaft of the drive motor 4. Another of these components is accordingly assigned to the drive side of the feed gear mechanism 5. The third of these components is finally braked or completely fixed, at least for auxiliary locking operation.

In this case, the sun wheel 20 is preferably assigned to the drive motor 4, especially the drive shaft of the drive motor 4. The internal gear 22 is formed by the drive housing 2 and is fixed accordingly. The planet gear carrier 21 is provided with an internal thread and thus forms the spindle nut 7. The internal thread in the planet gear carrier 21 is located, in particular, on the web plate of the planet gear carrier 21. However, fundamentally, it can also be provided that the spindle nut 7 is coupled directly to the planet gear carrier 21.

In the embodiment shown in FIG. 4, again, the basic principle of the feed gear mechanism 5 as shown in FIG. 3 is implemented. The rotation of the spindle nut 7 is converted into lengthwise motion of the spindle 6. For this purpose, it is again provided that the spindle 6 is provided with a projection 18 which runs in a lengthwise guide 17 for locking the spindle against rotation while allowing it to move in a lengthwise direction.

In all of the illustrated embodiments, the drive housing 2 has a single, continuous section. However, fundamentally, it is also possible for the drive housing 2 to be composed of several housing components. For example, it can be advantageous to provide the internal gear 22 of the planetary gearing system 5 in a separate drive housing, especially to be able to provide a correspondingly wear-proof material for this purpose.

In all of the illustrated embodiments, it is also such that the end piece 23 of the Bowden cable is supported on the drive housing 2. Here, support on a separate drive housing is also possible. It has been found to be especially advantageous if, as shown in FIG. 4, there is a lengthwise guide 17 for the locking element on this end piece 23 of the Bowden cable.

Finally, in all of the illustrated embodiments, it is such that the drive motor 4 is made as an electric drive motor. However, fundamentally, it is also possible for it to be a pneumatic or a hydraulic drive motor.

Quick mounting of the Bowden cable 3 acquires special importance here. This was already pointed out above. In addition to the proposed pre-mounting of the spindle 6 and the Bowden cable core 8 or the spindle nut 7 and Bowden cable core 8, it is conceivable that a type of quick acting closure of the Bowden cable be implemented. The Bowden cable core 8 would be inserted into an opening in the spindle 6 and spindle nut 7 and clamped fast in a self-locking manner when pulled back.

Electrical control of the auxiliary locking process, in the illustrated embodiments, is especially simple. To start an auxiliary locking process, the electrical drive motor 4 is energized in the first direction until the latch 10 has been transferred into its main locked position, especially into its overtravel position. After turning off the drive motor 4, the drive motor 4 is energized in the opposite direction until the spindle nut 7 or the spindle 6 reaches the initial position. It is fundamentally possible for there to be spring pretensioning, for example of the drive shaft of the drive motor 4, which provides for the drive motor 4 returning automatically into the initial position without repeated energizing.

In one especially preferred configuration, the auxiliary locking drive, especially the drive motor 4 with the intermediate gearing 16 which is optionally connected downstream and the feed gear mechanism 5 which is connected further downstream, is not made to be self-locking. This especially has the advantage that the arrangement can automatically drop back from the overtravel position into the main locked position after the drive motor 4 is turned off, by the high counterpressure of the door seal which is then acting.

In another preferred configuration, it is provided that at least the inside of the drive housing 2 is made essentially rotationally symmetrical relative to the lengthwise extension of the auxiliary locking drive. Optimum use of the available installation space can also be achieved with it.

It can be summarized that extraordinarily small installation space requirements are associated with all the illustrated embodiments. Furthermore, the small number of parts allows an especially low weight. As a result, production, especially installation, is possible with especially low cost.

It was explained in the Background part of this specification that, depending on the application, a different layout of the auxiliary locking drive in accordance with the invention is necessary. In order to implement this layout with minimum effort, in the preferred embodiment shown in FIG. 5, it is provided that the drive housing 2 and the support of the Bowden cable sheath 9, here of the end piece 23 of the Bowden cable, can be configured such that different drive motors 4, different intermediate gearings 16 and different feed gear mechanisms 5, each with different dimensions, can be used. In certain applications it may also be necessary to omit the intermediate gearing 16.

The aforementioned configuration capacity is preferably implemented by the drive housing 2 being made in two parts for adaptation to the respective drive motor 4 and/or the respective intermediate gearing 16. It can also be advantageous for the drive housing 2 to be composed of more than two parts.

For purposes of ease of configuration, at this point, it is preferable that the two parts 2*a*, 2*b* of the drive housing 2 are telescopic. In particular, this means that the first part 2*a* of the drive housing 2 can be slid over the second part 2*b* of the drive housing 2. The overlapping of the two parts 2*a*, 2*b* of the drive housing 2 makes it possible to adapt the length of the drive housing 2 to the respectively chosen components. There can be interlocking for attachment of the two parts 2*a*, 2*b* of the drive housing 2 to one another.

Figure 5:
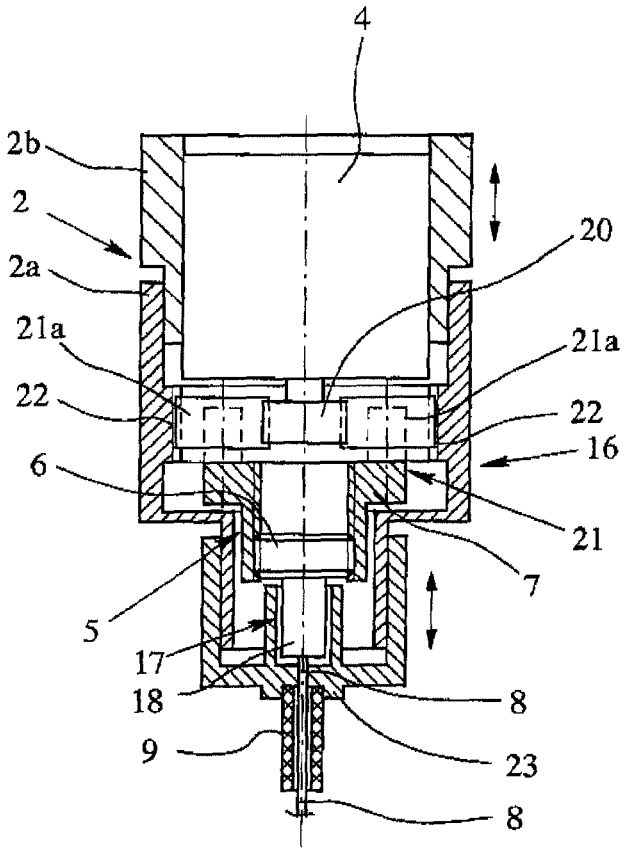
FIG. 5 shows the auxiliary locking drive of FIG. 4 with a telescoping drive housing and telescoping end piece of the Bowden cable.

The configuration illustrated in FIG. 5 also shows that the end piece 23 of the Bowden cable can be telescoped relative to the drive housing 2 to adapt to the respective feed gear mechanism 5. This can also be provided as an alternative to the telescoping capacity of the drive housing 2 instead of being in addition thereto. The telescoping capacity of the end piece 23 of the Bowden cable means that the end piece 23 of the Bowden cable can be slipped onto the drive housing 2 in different positions. Depending on the overlapping between the end piece 23 of the Bowden cable and the drive housing 2, adaptation to the respective feed gear mechanism 5 is possible. This relates especially to the layout of the auxiliary locking drive for different actuation strokes. Here, there is also preferably an interlocking attachment between the end piece 23 of the Bowden cable and the drive housing 2.

In certain applications, it can be advantageous for the core 8 of the Bowden cable 3 to be coupled to the spindle nut 7 off-center relative to the axle of the spindle 6. Then, it is also preferable that the spindle 6 likewise arranged to off-center relative to the drive shaft of the drive motor 4.

It is obvious that, for the aforementioned off-center arrangement, there is the danger of jamming of the spindle nut 7 relative to the spindle 6. As a result, for this case, it is preferable that there is a lengthwise guide 17 which is located parallel to the spindle 6 to support the spindle nut 7, on which guide the spindle nut 7 runs. The lengthwise guide 17 can be a guide rod which runs through the corresponding guide hole in the spindle nut 7. However, a guide groove is also possible which is engaged by the spindle nut 7 with a correspondingly web shape.

In an especially preferred embodiment, in any case, it is provided that there is a second spindle 6*a* which is coupled to the drive shaft of the drive motor 4 and that the spindle nut 7 has a second spindle nut thread which is assigned to this second spindle 6*a*. This can be seen in FIG. 6.

Figure 6:
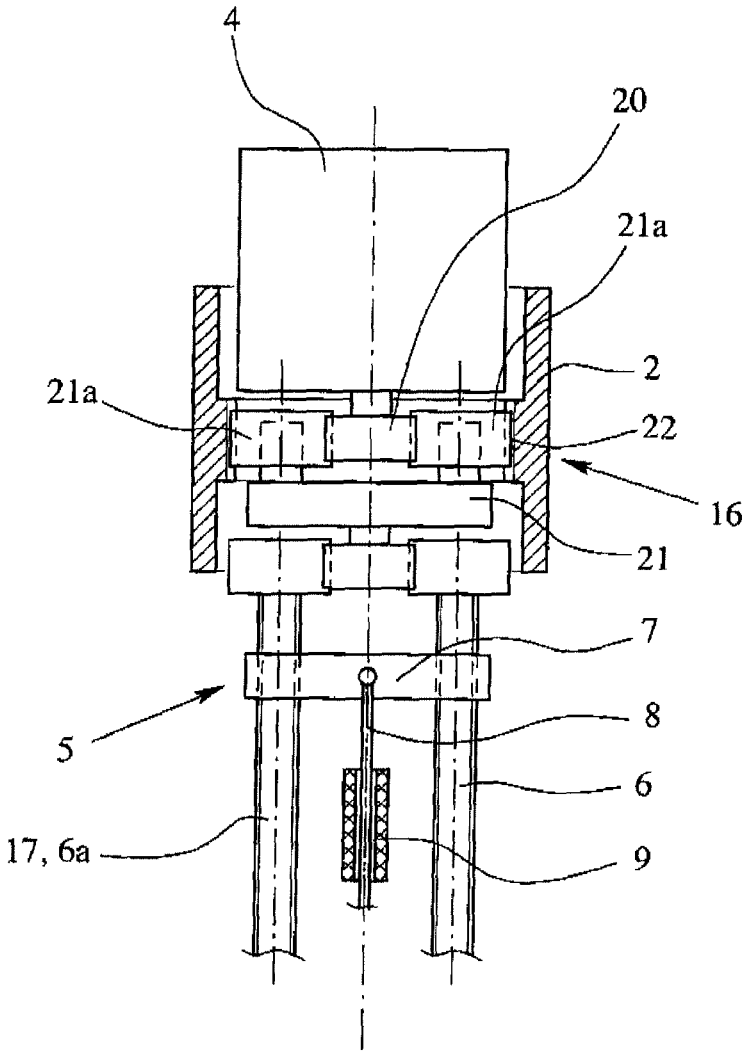
FIG. 6 shows the auxiliary locking drive in accordance with the invention with two drive spindles.

The embodiment shown in FIG. 6, similar to the embodiment shown in FIG. 5, has a drive motor 4, a planet gear carrier 16 connected downstream, and spindle nut gearing 5 which is in turn connected downstream and which has two spindles 6, 6*a*. The two spindles 6, 6*a* are coupled to the planet gear carrier 21 of the planetary gearing system by the planet gear carrier 21 having a spur gear which meshes with the spur gears of the two spindles 6, 6*a*. In the preferred embodiment shown in FIG. 6, the two spindles 6, 6*a* turn in opposite directions so that the spindle thread must be accordingly oriented differently.

Here, the two spindles 6, 6*a* are preferably arranged symmetrically relative to the drive shaft of the drive motor 4. With this symmetrical arrangement, the danger of jamming of the spindle nut 7 on one of the two spindles 6, 6*a* is extremely low. This increases the operating reliability of the auxiliary locking drive in accordance with the invention altogether.

What is claimed is:

1. Auxiliary locking drive for a motor vehicle lock, comprising:

a drive housing constructed for being located separate from the motor vehicle lock in an installed state connected to the motor vehicle lock, a drive arrangement with a drive motor for producing a linear driving motion in the installed state, and a transmission means for drivingly coupling the drive motor to the vehicle lock for transferring the vehicle lock from a half-locked state into a main locked state by the linear driving motion, wherein the drive arrangement, for producing the linear driving motion, comprises a feed gear mechanism which is connected to a drive shaft of the drive motor and wherein the feed gear mechanism comprises spindle-spindle nut gearing with a spindle and a spindle nut, wherein the spindle has a spindle thread and the spindle nut has a spindle nut thread engaging the spindle thread, wherein the spindle is assigned to a driven side of the spindle-spindle nut gearing and the spindle nut is assigned to a drive side of the spindle-spindle nut gearing, wherein the drive motor is connected to drive the spindle nut, wherein the drive arrangement is adapted to convert rotation of the spindle nut into lengthwise motion of the spindle, wherein the spindle is provided with a projection which runs in a lengthwise guide for locking the spindle against rotation while allowing it to move in a lengthwise direction, and wherein the lengthwise guide is arranged within the drive housing.

2. Auxiliary locking drive in accordance with claim 1, wherein the transmission means comprises a Bowden cable with a core and a sheath.

3. Auxiliary locking drive in accordance with claim 1, wherein the spindle is assigned to a drive side of the spindle-spindle nut gearing and the spindle nut is assigned to a driven side of the spindle-spindle nut gearing.

4. Auxiliary locking drive in accordance with claim 1, wherein the drive motor, an intermediate gearing, and the feed gear mechanism are arranged in succession in the drive housing.

5. Auxiliary locking drive in accordance with claim 1, wherein the drive motor, an intermediate gearing, and the feed gear mechanism are at least partially inter-nested in one another in the drive housing relative to a lengthwise axis of the auxiliary locking drive.

6. Auxiliary locking drive in accordance with claim 1, wherein the drive shaft of the drive motor is a hollow shaft and wherein the hollow shaft forms the spindle nut of the spindle-spindle nut gearing.

7. Auxiliary locking drive in accordance with claim 6, wherein the drive motor is a direct electrical drive.

8. Auxiliary locking drive in accordance with claim 6, wherein the spindle of the feed gear mechanism is located completely within the spindle nut.

9. Auxiliary locking drive in accordance with claim 2, wherein the spindle together with the Bowden cable core forms a pre-mountable unit.

10. Auxiliary locking drive in accordance with claim 1, wherein an intermediate gearing is connected between the drive motor and the feed gear mechanism, wherein the intermediate gearing is a planetary gearing system, wherein the planetary gearing system has a sun wheel, a planet gear carrier and an internal gear, wherein the planet gear carrier is assigned to the drive side of the feed gear mechanism and wherein the planet gear carrier forms, or is coupled directly to, the spindle nut.

11. Auxiliary locking drive in accordance with claim 2, wherein the drive housing is configurable for use with at least one of various elements from the group consisting of different drive motors, intermediate gearings and different feed gear mechanisms of various different dimensions.

12. Auxiliary locking drive in accordance with claim 11, wherein the drive housing comprises two parts which are adaptable to the size of the at least one of said various elements selected.

13. Auxiliary locking drive in accordance with claim 12, wherein the parts of the drive housing are telescopically connected.

14. Auxiliary locking drive in accordance with claim 2, wherein the core of the Bowden cable is coupled to the spindle nut at a position that is off-center relative to a center axis of the spindle.

15. Auxiliary locking drive in accordance with claim 1, wherein the spindle nut runs on a lengthwise guide which is located parallel to the spindle for restricting rotation of the spindle nut while allowing longitudinal movement thereof relative to the spindle.

16. Auxiliary locking drive in accordance with claim 1, wherein the spindle-spindle nut gearing further comprising a second spindle, the spindle nut being drivingly coupled to the drive motor both spindles.

17. A lock assembly comprising a motor vehicle lock having a latch, a ratchet and a striker which is assigned to the latch, and an auxiliary locking drive, the auxiliary locking drive comprising:

a drive housing located separate from the motor vehicle lock, a drive arrangement with a drive motor for producing a linear driving motion, and a transmission means for drivingly coupling the drive motor to the motor vehicle lock for transferring the vehicle lock from a half-locked state into a main locked state by the linear driving motion, wherein the drive arrangement, for producing the linear driving motion, comprises a feed gear mechanism which is connected downstream of the drive motor, wherein the feed gear mechanism comprises spindle-spindle nut gearing with a spindle and a spindle nut, wherein the spindle has a spindle thread and the spindle nut has a spindle nut thread engaging the spindle thread, wherein the spindle is assigned to a driven side of the spindle-spindle nut gearing and the spindle nut is assigned to a drive side of the spindle-spindle nut gearing, wherein the drive motor is connected to drive the spindle nut, wherein the drive arrangement is adapted to convert rotation of the spindle nut into lengthwise motion of the spindle, wherein the spindle is provided with a projection which runs in a lengthwise guide for locking the spindle against rotation while allowing it to move in a lengthwise direction, and wherein the lengthwise guide is arranged within the drive housing.

18. Lock assembly in accordance with claim 17, wherein the latch is movable into a half-closed position and into the main closed position, wherein the ratchet is adapted to hold the latch in the main closed position, wherein the auxiliary locking drive is drivingly coupled to the latch and wherein the latch is movable by the linear drive motion produced by the auxiliary locking drive from the half-locked position into the main locked position so that the vehicle lock is movable from the half-locked state into the main locked state.

* * * * *